US007973742B2

(12) United States Patent
Baik et al.

(10) Patent No.: US 7,973,742 B2
(45) Date of Patent: Jul. 5, 2011

(54) METHOD OF DRIVING FIELD EMISSION DEVICE (FED) AND METHOD OF AGING FED USING THE SAME

(75) Inventors: Chan-Wook Baik, Yongin-si (KR); Jeong-Hee Lee, Yongin-si (KR); Jeong-Na Heo, Yongin-si (KR); Deuk-Seok Chung, Yongin-si (KR); Tae-Won Jeong, Yongin-si (KR); Kyoung-Won Min, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 960 days.

(21) Appl. No.: 11/797,339

(22) Filed: May 2, 2007

(65) Prior Publication Data

US 2007/0257865 A1 Nov. 8, 2007

(30) Foreign Application Priority Data

May 3, 2006 (KR) ..... 10-2006-0040082

(51) Int. Cl.
*G09G 3/20* (2006.01)

(52) U.S. Cl. ..... 345/75.2; 345/74.1; 345/55; 345/56; 345/58; 345/59

(58) Field of Classification Search ..... 345/75.2, 345/74.1, 76–79, 82, 98–102, 204, 206, 209, 345/213, 55–59; 315/209 R, 291, 246, 169.1, 315/169.3; 313/495, 309, 336, 607, 484, 313/505, 441, 497, 503; 445/3, 5, 6
See application file for complete search history.

(56) References Cited

U.S. PATENT DOCUMENTS

| | | | | |
|---|---|---|---|---|
| 3,305,640 | A * | 2/1967 | Schutte et al. | 381/11 |
| 5,801,486 | A * | 9/1998 | Johnson et al. | 313/495 |
| 5,844,531 | A * | 12/1998 | Betsui | 345/74.1 |
| 6,153,123 | A * | 11/2000 | Hampden-Smith et al. | 252/301.4 S |
| 6,204,834 | B1 * | 3/2001 | Baker et al. | 345/75.2 |
| 6,366,266 | B1 * | 4/2002 | Zhang et al. | 345/74.1 |
| 6,452,328 | B1 * | 9/2002 | Saito et al. | 313/495 |
| 6,465,966 | B2 * | 10/2002 | Konuma | 315/169.1 |
| 6,897,620 | B1 * | 5/2005 | Takeuchi et al. | 315/169.3 |
| 7,176,478 | B2 * | 2/2007 | Kastalsky et al. | 257/9 |

(Continued)

FOREIGN PATENT DOCUMENTS

CN 2758818 Y 2/2006

(Continued)

OTHER PUBLICATIONS

*Office Action* from the Chinese Patent Office issued in Applicant's corresponding Chinese Patent Application No. 2006101711383 dated Jul. 4, 2008.

(Continued)

*Primary Examiner* — Prabodh M Dharia
(74) *Attorney, Agent, or Firm* — Cantor Colburn LLP

(57) ABSTRACT

A method for driving a field emission device (FED) applies an alternating (AC) voltage as a driving voltage for emitting electrons in a field emission device comprising cathode electrode including an emitter and an anode electrode facing the cathode electrode. A method for aging an FED uses a constant voltage so that electrons cannot be emitted from the electron emission source, and an AC voltage so that electrons can be periodically emitted from the emitter when the FED is aged.

22 Claims, 15 Drawing Sheets

U.S. PATENT DOCUMENTS

| | | | | |
|---|---|---|---|---|
| 7,304,420 | B2 * | 12/2007 | Rose et al. | 313/309 |
| RE40,490 | E * | 9/2008 | Zhang et al. | 345/75.2 |
| 7,515,851 | B2 * | 4/2009 | Hirakawa et al. | 399/168 |
| 7,524,227 | B2 * | 4/2009 | Nishimura | 445/6 |
| 7,586,272 | B2 * | 9/2009 | Iida et al. | 315/291 |
| 2002/0011777 | A1 * | 1/2002 | Konishi et al. | 313/495 |
| 2003/0090199 | A1 * | 5/2003 | Saita et al. | 313/509 |
| 2003/0108478 | A1 | 6/2003 | Hiraoka | |
| 2004/0130510 | A1 * | 7/2004 | Konishi et al. | 345/75.2 |
| 2005/0052129 | A1 * | 3/2005 | Yamashita | 313/506 |
| 2005/0179366 | A1 * | 8/2005 | Rose et al. | 313/503 |
| 2005/0202745 | A1 * | 9/2005 | Nishimura | 445/5 |
| 2005/0247929 | A1 * | 11/2005 | Kastalsky et al. | 257/46 |
| 2006/0202607 | A1 * | 9/2006 | Sano et al. | 313/495 |

FOREIGN PATENT DOCUMENTS

| | | | |
|---|---|---|---|
| KR | 2002002968 | * | 1/2002 |

OTHER PUBLICATIONS

Chinese Office Action dated Feb. 27, 2009 with English Translation, corresponding to Chinese Patent Application No. 200610171138.3.

* cited by examiner

FIG. 5A (1)
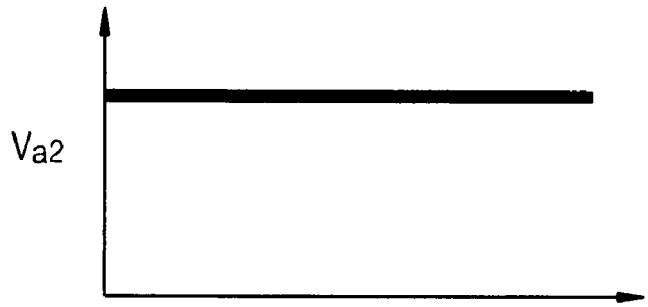
FIG. 5A (2)
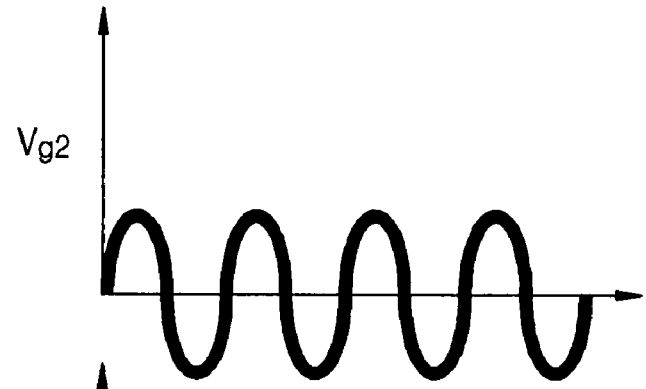
FIG. 5A (3)
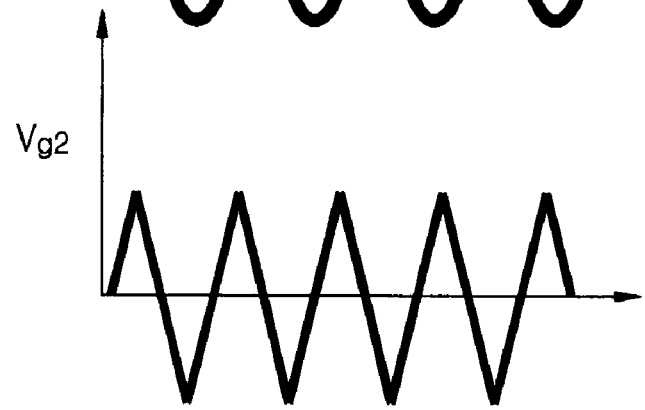
FIG. 5A (4)
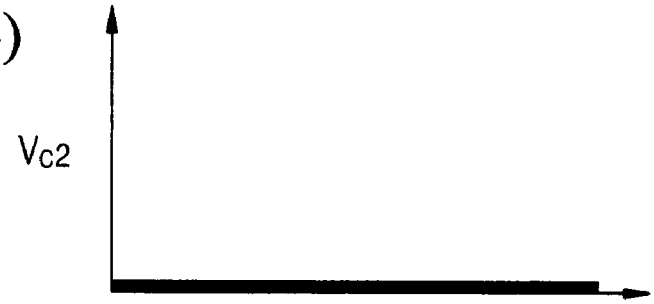

FIG. 5B (1)
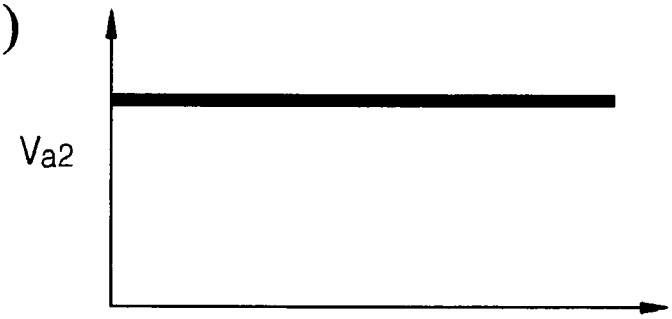
FIG. 5B (2)
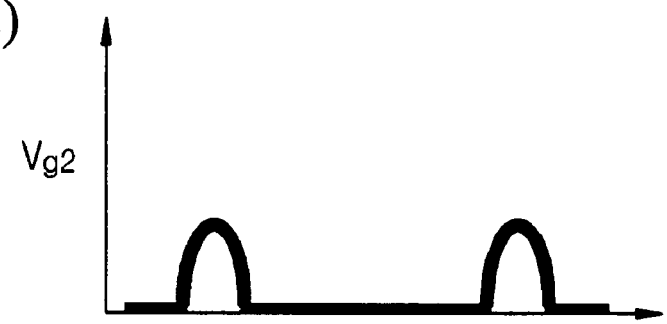
FIG. 5B (3)
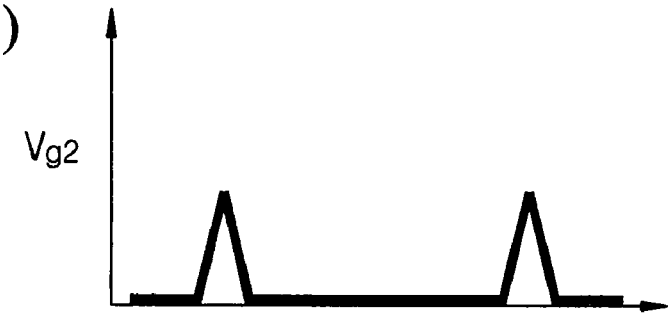
FIG. 5B (4)
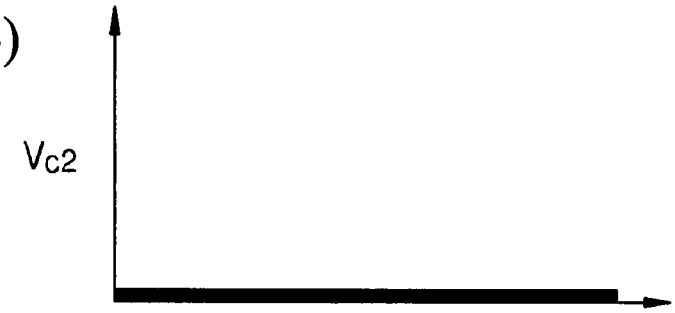

FIG. 6A (1)
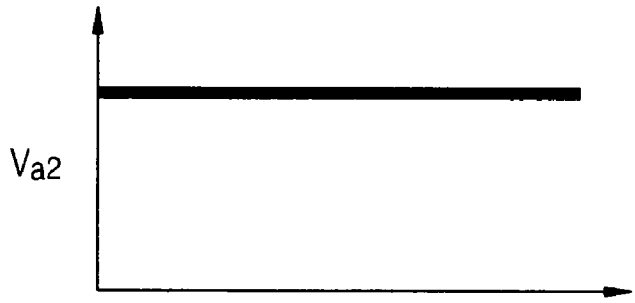
FIG. 6A (2)
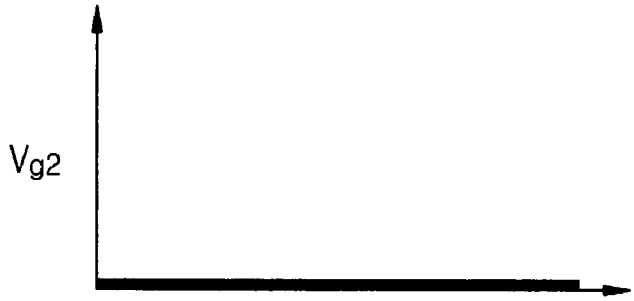
FIG. 6A (3)
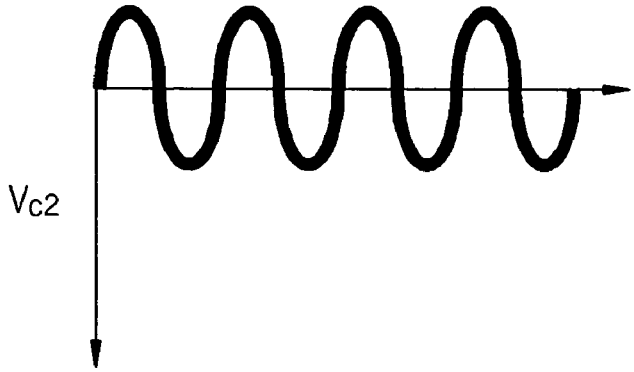
FIG. 6A (4)
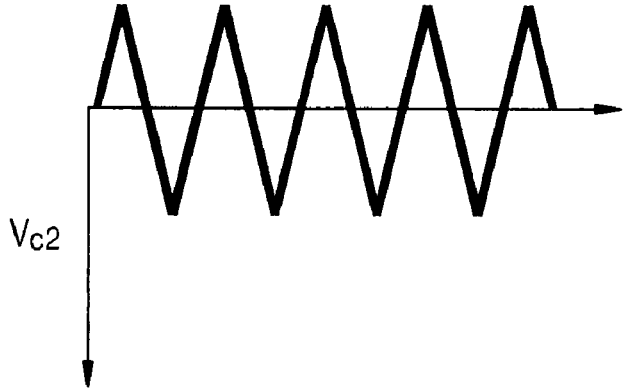

FIG. 6B (1)
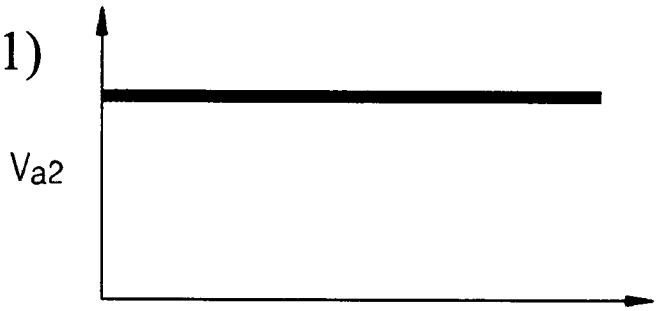
FIG. 6B (2)
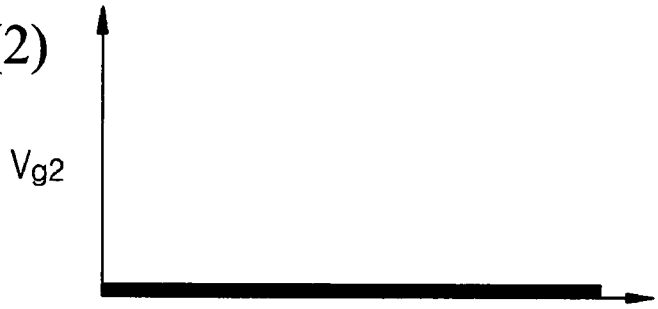
FIG. 6B (3)
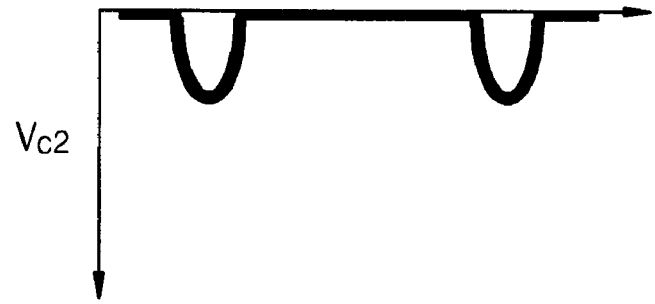
FIG. 6B (4)
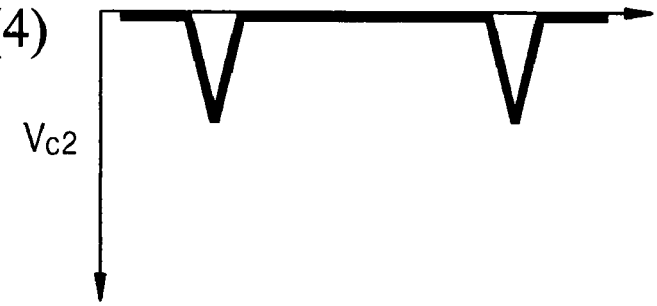

DC 1600 V, 0.267 mA
Uniformity : 60%

DC 1700 V, 0.427 mA
Uniformity : 50%

DC 1900 V, 1.577 mA

AC 900 V, 120 Hz, DC 1000 V, 0.194 mA
Uniformity: 69%

AC 1000 V, 120 Hz, DC 1000 V, 0.360 mA
Uniformity: 61%

AC 1300 V, 600 Hz,
DC 1000 V, 1.390 mA

DC 1200 V, 0.336 mA, 37%

Pulse 565 V, 120 Hz,
DC 1000 V, 0.371 mA, 49%

AC 700 V, 120 Hz,
DC 1000 V, 0.305 mA, 56%

DC 1200 V, 0.411 mA, 35%

Pulse 636 V, 120 Hz,
DC 1000 V, 0.483 mA, 39%

AC 800 V, 120 Hz,
DC 1000 V, 0.450 mA, 51%

DC 1400 V, 0.961 mA

AC 1000 V, 120 Hz,
DC 1000 V, 0.829 mA

FIG. 12A
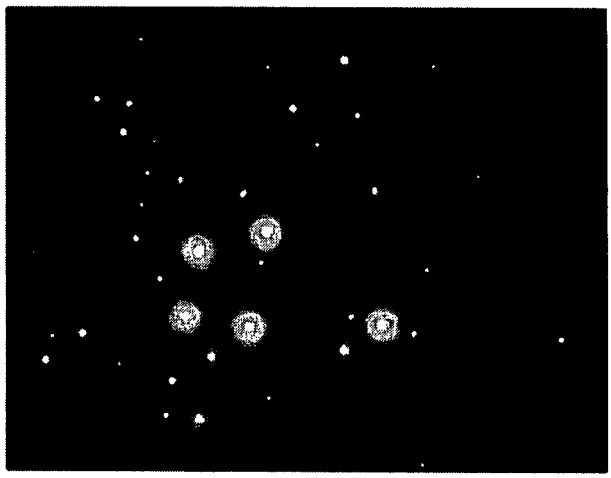
1. [before Aging]
AC 0 V , 0 Hz, DC1200 V
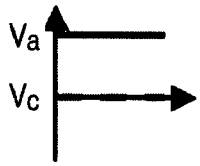
FIG. 12B
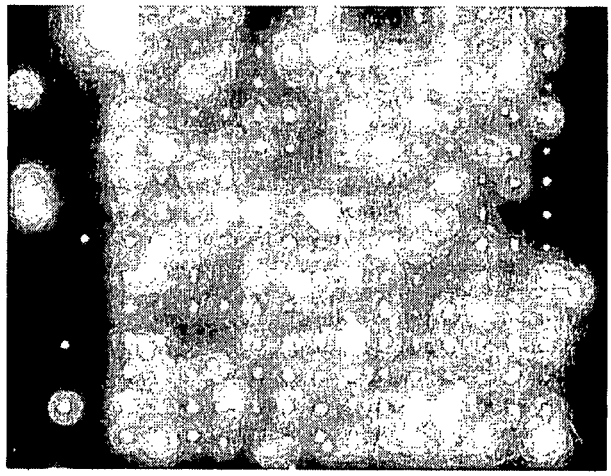
2. [during AC aging]
AC 1 kV , 120 Hz, DC 1400 V, 92 μA
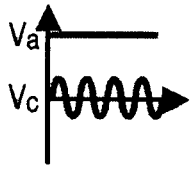

FIG. 12C
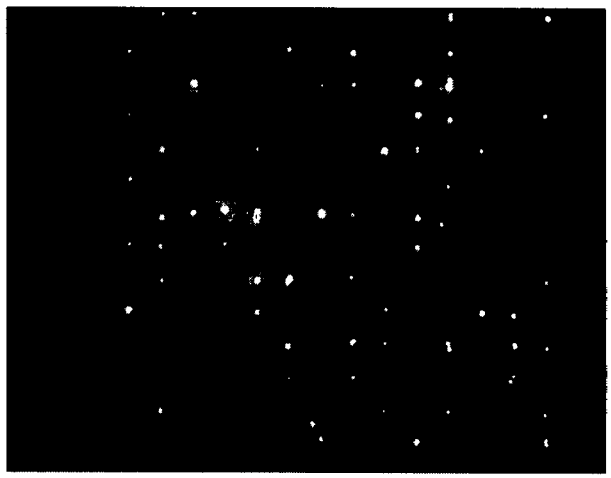
3. [after AC aging]
AC 0 V , 0 Hz, DC 1400 V, 5 μA
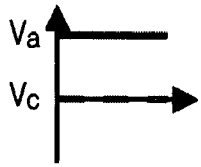
FIG. 13
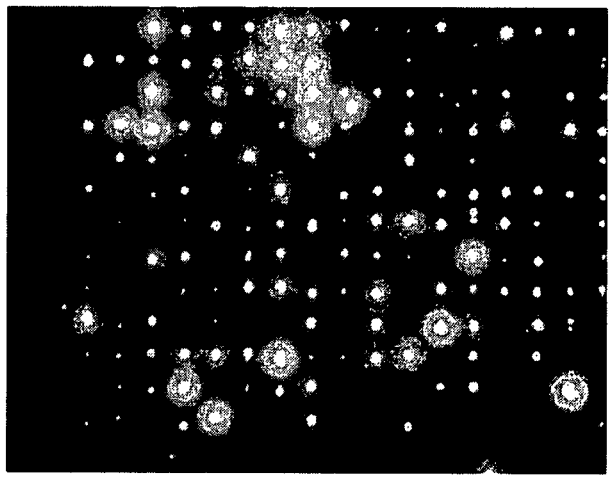
DC 900 V, 0.288 mA DC 1700 V, 1.030 mA, 58%

AC 100 V, 120 Hz,
DC 1700 V, 1.016 mA, 60%

AC 1240 V, 120 Hz,
DC 800 V, 1.014 mA, 66%

DC 1500 V, 0.271 mA

DC 1800 V, 1.554 mA

DC 2000 V, 2.488 mA

METHOD OF DRIVING FIELD EMISSION DEVICE (FED) AND METHOD OF AGING FED USING THE SAME

CLAIM OF PRIORITY

This application makes reference to, incorporates the same herein, and claims all benefits accruing under 35 U.S.C. §119 from an application for DRIVING METHOD OF FIELD EMISSION DEVICE AND AGING METHOD USING THE SAME earlier filed in the Korean Intellectual Property Office on 3 May 2006 and there duly assigned Serial No. 10-2006-0040082.

BACKGROUND OF THE INVENTION

1. Field of the Invention

The present invention relates to a method for driving a field emission device (FED) and a method for aging a field emission display apparatus using the same, and more particularly, to a method for preventing arcing by applying an alternating (AC) voltage as a driving voltage to an FED and improving uniformity of electron emission of a field emission display apparatus comprising a plurality of FEDs.

2. Description of the Related Art

Field emitter array (FEA) type electron emission devices, surface conduction emitter (SCE) type electron emission devices, metal insulator metal (MIM) type electron emission devices, metal insulator semiconductor (MIS) type electron emission devices, and ballistic electron surface emitting (BSE) type electron emission devices use cold cathodes.

Among the electron emission devices, when field emission devices (FEDs), i.e., the FEA type electron emission devices, use a material having a low work function or a high β function as an electron emission source, they employ a principle that electrons are easily emitted in a vacuum state due to a tunneling effect caused by an electric field. The emitter is a tip structure having a sharp leading end made from molybdenum (Mo), silicon (Si), or other similar materials, or a carbon material such as graphite, or diamond like carbon (DLC). Recently, FEDs use nano materials such as nano tubes or nano wires.

The FEA type electron emission devices, i.e., FEDs, are classified as two-electrode structure FEDs and three-electrode structure FEDs according to the arrangement of electrodes.

A two-electrode structure FED is typically constructed with a cathode electrode having an emitter disposed on the upper surface of the cathode electrode, and an anode electrode facing the cathode electrode in order to emit electrons by using an electric potential difference between the cathode electrode and the anode electrode.

A three-electrode structure FED is typically constructed with a gate electrode adjacent to the cathode electrode in order to instigate the emission of electrons. A field emission display apparatus incorporating FEDs includes phosphor material layers on the surface of the anode electrode; the electrons emitted from the emitter are accelerated by the anode electrode to emit light upon impact with the phosphor material.

A contemporary method for driving FEDs applies a driving voltage in the form of a direct current (DC) voltage or a pulse to the electrodes. When the driving voltage is powered on, a voltage drop between the cathode electrode and the anode electrode remains constant, so that a lot of electrostatic particles gather around a tip of the electron emission source, which may cause arcing between the electrostatic particles. In particular, when the driving voltage is either powered off from a power-on state or powered-on from a power-off state, overshoot occurs, which is more likely to cause arcing.

Furthermore, a field emission display apparatus including a plurality of FEDs can easily obtain inconstant light emission such as a hot spot and a dead spot due to a small non-uniform difference between a plurality of tips of the electron emission source. To address this problem, an aging process is performed. The contemporary method for driving FEDs causes a high possibility of arcing during the aging process, and undesirably maintains the hot spot or the dead spot after the aging process is completed.

SUMMARY OF THE INVENTION

It is therefore an object of the present invention to provide an improved method for driving a field emission device (FED).

It is another object to provide an improved method for aging a field emission device (FED).

It is yet another object to provide a method for preventing arcing when a field emission device (FED) is driven and for improving uniformity of electron emission of an apparatus including a plurality of FEDs.

It is still another object to provide a method for reducing the effect of a hot spot and activating a dead spot when the apparatus including the plurality of FEDs is aged.

According to an aspect of the present invention, there is provided a method for driving a field emission device (FED) constructed with a cathode electrode including an emitter, and an anode electrode facing the cathode electrode, with an alternating (AC) voltage is used as a driving voltage for electron emission.

The AC voltage may have a waveform which continuously varies as a function of time when electrons are emitted, and may be either a sine wave or a triangular wave. The AC voltage may be a digital signal having a waveform which substantially continuously varies as a function of time when electrons are emitted, and may be either a sine wave or a triangular wave.

According to another aspect of the present invention, there is provided a method for driving a two-electrode structure FED constructed with a cathode electrode including an emitter and an anode electrode facing the cathode electrode, by applying a constant voltage across the cathode electrode and the anode electrode so that electrons cannot be emitted from the electron emission source, and an AC voltage is simultaneously applied to one electrode selected from among the cathode electrode and the anode electrode so that electrons will be periodically emitted from the electron emission source.

According to still another aspect of the present invention, there is provided a method for driving a three-electrode structure FED constructed with a cathode electrode including an electron emission source, an anode electrode facing the cathode electrode, and a gate electrode adjacent to the electron emission source, by applying a constant voltage to each one of the cathode electrode, the anode electrode, and the gate electrode so that electrons cannot be emitted from the electron emission source, and an AC voltage is simultaneously applied to either one or two electrodes selected from among the cathode electrode, the anode electrode, and the gate electrode so that electrons will be periodically emitted from the electron emission source.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 5A and 5B are graphs illustrating driving voltages for the three-electrode structure FED illustrated in FIG. 4 according to an embodiment of the principles of the present invention;

FIGS. 6A and 6B are graphs illustrating driving voltages for the three-electrode structure FED illustrated in FIG. 4 according to another embodiment of the principles of the present invention;

FIGS. 12A through 12C are photographs of an FED display apparatus using an aging process according to an embodiment of the principles of the present invention;

FIG. 13 is the photograph of an FED display apparatus driven by applying constant voltages to both of the cathode and anode electrodes, before being aged;

DETAILED DESCRIPTION OF THE INVENTION

Figure 1:
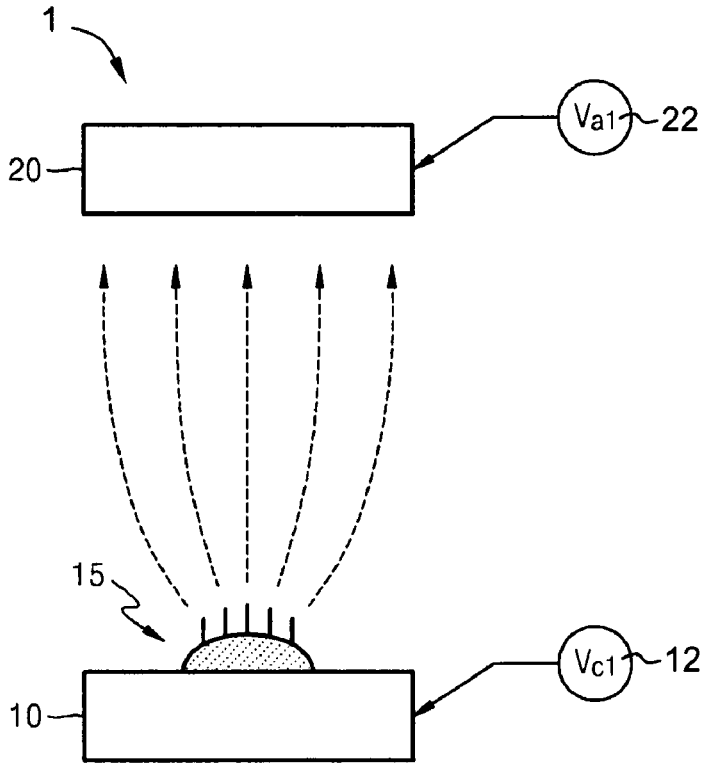
FIG. 1 illustrates a two-electrode structure field emission device (FED)

The present invention will now be described more fully with reference to the accompanying drawings in which exemplary embodiments of the invention are shown. Like reference numerals refer to like elements throughout the drawings. In the drawings, the thickness of layers and regions are exaggerated for clarity.

Figure 2:
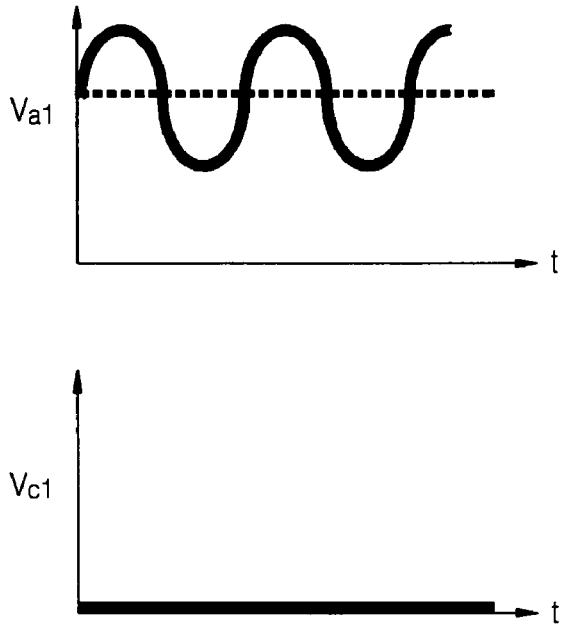
FIG. 2 is a graph illustrating driving voltages for the two-electrode structure FED illustrated in FIG. 1 according to an embodiment of the principles of the present invention.
Figure 3:
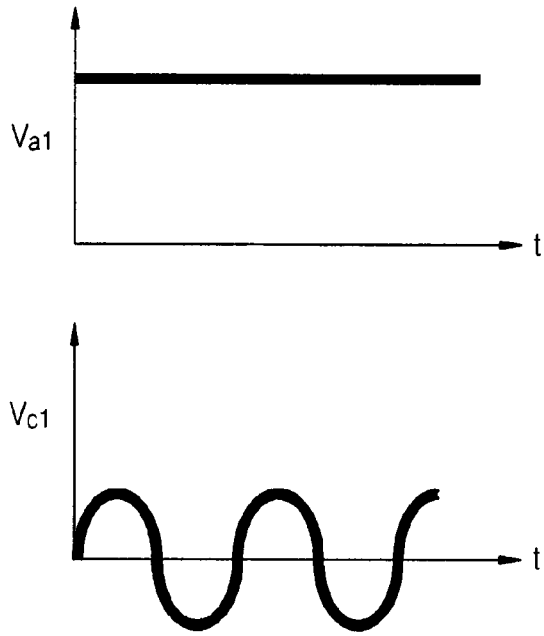
FIG. 3 is a graph illustrating driving voltages for the two-electrode structure FED illustrated in FIG. 1 according to another embodiment of the principles of the present invention.

FIG. 1 illustrates a two-electrode structure field emission device (FED). FIGS. 2 and 3 are graphs illustrating driving voltages for the two-electrode structure FED illustrated in FIG. 1 according to embodiments of the principles of the present invention.

According to FIG. 1, a two-electrode structure FED 1 is constructed with a cathode electrode 10 including an emitter 15, and an anode electrode 20 facing cathode electrode 10. Vc1 denotes a driving voltage for cathode electrode 10. Terminal of the cathode driving circuit is 12. Va1 denotes a driving voltage for anode electrode 20. Terminal of the anode driving circuit is 22. Referring to FIG. 2, a constant voltage Vc1 is applied to cathode electrode 10, and a driving voltage Va1 which is a set constant voltage upon which an alternating (AC) voltage is superimposed, is applied to anode electrode 20. For example, Vc1 can be a ground or other reference electric potential. The set constant voltage can be a high voltage such that the two-electrode structure FED to which a driving method of the principles of the present invention is applied does not start emitting electrons. That is, a voltage difference between the constant voltage Vc1 applied to cathode electrode 10 and the set constant voltage applied to anode electrode 20 can be less than a threshold voltage necessary for the two-electrode structure FED to start emitting electrons. The voltage difference can be between several hundred through several thousand volts. The voltage difference can vary according to a distance between cathode electrode 10 and anode electrode 20 and to the characteristics of emitter 15. The peak-to-peak value of the AC voltage can be between several hundred through several thousand volts. The peak-to-peak value of the AC voltage can be measured by an oscilloscope. The frequency of the AC voltage can be between several hundred through several thousand kHz. The peak-to-peak value and frequency of the AC voltage can vary according to the electric field between cathode electrode 10 and anode electrode 20, the characteristics of emitter 15, and a duty rate required to drive the two-electrode structure FED. The duty rate is the ratio between the working time and the total operating time for an intermittently operating device, such as a liquid crystal display (LCD) or a FED. In the case of a FED, since there are many scan lines in order to save power, the duty rate of each scan line is much less than 50%. The two-electrode structure FED is periodically powered on and off according to the changing peak-to-peak value of the AC voltage.

The constant voltage difference applied across cathode electrode 10 and anode electrode 20 may be in the range of approximately −30 kV through approximately +30 kV because a high voltage beyond this range can deleteriously reduce stability or the lifetime of the two-electrode structure FED. Similarly, the AC voltage may have a maximum value (i.e., a peak voltage) between 0 to approximately 30 kV, a frequency between 0 to approximately 1 MHz, and a duty rate between approximately $1/10{,}000$ to approximately $1/2$.

The AC voltage can have a waveform which continuously varies as a function of time, when electrons are emitted. The waveform may be either a sine wave or a triangular wave, etc. When the two-electrode structure FED is controlled by using a digital signal instead of an analog signal, the AC voltage can be the digital signal having a waveform which substantially continuously varies as a function of time. In detail, the AC voltage can be the digital signal having a similar waveform to that of the analog signal. In this case, the waveform can be either the sine wave or the triangular wave, etc. The driving voltage having a waveform which continuously varies as a function of time is used to prevent arcing due to overshoot.

The operation, whereby the driving voltage is applied to the two-electrode structure FED illustrated in FIG. 1, will now be described. If a reference voltage indicated as a dotted line in graph Va1 illustrated in FIG. 2 is a threshold voltage for emitter 15 to emit electrons, then when Va1 is higher than the reference voltage, emitter 15 emits electrons, and when Va1 is lower than the reference voltage, emitter 15 stops emitting electrons. The above described operation periodically repeats.

AC voltage Va1 periodically varies so that an electric field between cathode electrode 10 and anode electrode 20 periodically varies. The periodic variance of the electric field does not concentrate charged particles between cathode electrode 10 and anode electrode 20, but vibrates the charged particles, which considerably reduces arcing between cathode electrode 10 and anode electrode 20.

When emitter 15 uses carbon nano tubes (CNTs), different forces are applied to CNTs, which are electron emission tips, according to the variance of the strength of the electric field, so that leading ends of the CNTs can weakly vibrate. The weak vibration can improve characteristics of electron emission of emitter 15. In particular, when the two-electrode structure FED is aged by using the driving method of the present invention, the weak vibration activates the inactive emitter 15, i.e., contributes to the activation of a dead spot.

Referring to FIG. 3, a constant voltage Va1 is applied to anode electrode 20 and an AC voltage Vc1 is applied to cathode electrode 10 according to another embodiment of the principles of the present invention. Since emitter 15 emits electrons using a voltage difference between voltage Vc1 of cathode electrode 10 and voltage Va1 of anode electrode 20, the driving operation and characteristics based on the AC voltage are similar to the driving operation and characteristics of the previous described embodiment of FIG. 2. Therefore, a condition for the constant voltage applied to anode electrode 20 and the AC voltage applied to cathode electrode 10 in FIG. 3 is an alternative to the application of a constant voltage applied to cathode electrode 10 and the AC voltage applied to anode electrode 20 as described with reference to the previous embodiment of FIG. 2.

Figure 4:
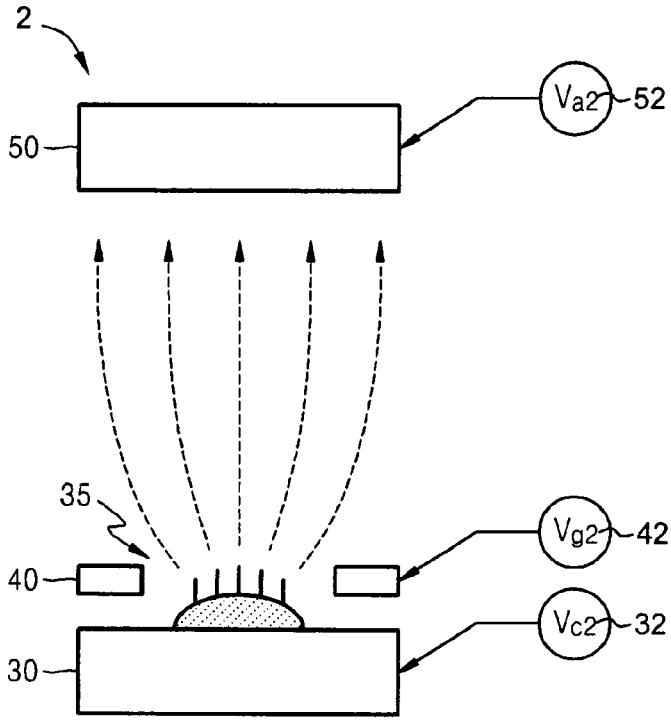
FIG. 4 illustrates a three-electrode structure FED.

FIG. 4 illustrates a three-electrode structure FED. FIGS. 5A through 6B are graphs illustrating alternative techniques for applying driving voltages to the three-electrode structure FED illustrated in FIG. 4. Referring to FIG. 4, three-electrode structure FED 2 is constructed with a cathode electrode 30 including an emitter 35, an anode electrode 50 facing cathode electrode 30, and a gate electrode 40 adjacent to emitter 35. An insulating layer (not shown) can be disposed between gate electrode 40 and cathode electrode 30. Gate electrode 40 is not restricted, however, to an upper side gate structure in which gate electrode 40 is formed at an upper side of emitter 35 as illustrated in FIG. 4, but can have a lower side gate structure in which gate electrode 40 is formed at a lower side of emitter 35. Gate electrode 40 can be implemented with other structures. Vc2 denotes a driving voltage for cathode electrode 30. Terminal of the cathode driving circuit is 32. Va2 denotes a driving voltage for anode electrode 50. Terminal of the anode driving circuit is 52. Vg2 denotes a driving voltage for gate electrode 40. Terminal of the gate driving circuit is 42.

Referring to FIG. 5A, a set constant voltage, e.g., a ground voltage, is applied to cathode electrode 30 as a driving voltage Vc2 as illustrated in FIG. 5A(4), and another set constant voltage is applied to anode electrode 50 as a driving voltage Va2 as illustrated in FIG. 5A(1). At the same time, a driving voltage Vg2 which is an AC voltage superimposed upon a ground, or a constant reference voltage, is applied to gate electrode 40 as illustrated in FIG. 5A(2) and(3). The AC voltage is applied to gate electrode 40 which is relatively closer to anode electrode 50 to which a high voltage is applied, thereby reducing arcing caused by accumulation of charged particles.

A voltage difference between the constant voltages Va2 and Vc2 respectively applied to cathode electrode 30 and anode electrode 50 can be a high voltage which is less than a threshold voltage necessary for the three-electrode structure FED to start emitting electrons. The voltage difference can be about several hundred through several thousand volts. The magnitude of the voltage difference can vary according to a distance between cathode electrode 30 and anode electrode 50 and characteristics of emitter 35. The AC voltage can be between approximately several hundred through approximately several thousand volts. The frequency of the AC voltage can be several hundred through several thousand kHz. The peak-to-peak value and the frequency of the AC voltage can vary according to the electric field between cathode electrode 30 and anode electrode 50, the characteristics of emitter 35, and a duty rate required to drive the three-electrode structure FED. The three-electrode structure FED is periodically powered on and off according to the changing peak-to-peak value of the AC voltage.

The magnitude of the constant voltage applied across cathode electrode 30 and anode electrode 50 may be in the range of approximately −30 kV through approximately +30 kV because a high voltage beyond this range can reduce the stability or the lifetime of the three-electrode structure FED. Similarly, the AC voltage may have a maximum value between 0 to approximately 30 kV, a frequency between 0 to approximately 1 MHz, and a duty rate between approximately $1/10{,}000$ to approximately $1/2$.

The AC voltage can have a waveform which continuously varies as a function of time when electrons are emitted as described with reference to the two-electrode structure FED of the previous embodiments. The waveform is either a sine wave as illustrated in FIG. 5A(2) or a triangular wave as illustrated in FIG. 5A(3), etc. When the three-electrode structure FED is controlled by using a digital signal instead of an analog signal, the AC voltage can be the digital signal having a waveform which substantially continuously varies as a function of time. In detail, the AC voltage can be the digital signal having a similar waveform to that of the analog signal. In this case, the waveform can be either a sine wave or a triangular wave, etc. The driving voltage having a waveform which continuously varies as a function of time is used to prevent arcing due to overshoot.

Referring to FIG. 5B which illustrates a modification of a waveform of driving voltage Vg2 of gate electrode 40 illustrated in FIG. 5A, the upper portion of either the sine wave as illustrated in FIG. 5B(2) or the triangular wave as illustrated in FIG. 5B(3) which is higher than a certain voltage can be used when the three-electrode structure FED is operated.

Referring to FIG. 6A, a driving voltage Vc2 which is an overlap of a ground voltage and a set AC voltage, is applied to cathode electrode 30 as either the sine wave or the triangular wave respectively illustrated in FIG. 6A(3) and (4), a set constant voltage, i.e., the ground voltage, is applied to gate electrode 40 as a driving voltage Vg2 as illustrated in FIG. 6A(2), and another set constant voltage is applied to anode electrode 50 as a driving voltage Va2 as illustrated in FIG. 6A(1). A voltage difference between Va2 and Vg2 can be a high voltage which is less than a threshold voltage for the three-electrode structure FED to which a driving method of an embodiment of the principles of the present invention is applied, to start emitting electrons. The peak-to-peak value and frequency of AC voltage Vc2 allow emitter 35 to periodically emit electrons due to an electric field between emitter 35 of cathode electrode 30 and gate electrode 40. The condition for the set constant voltages applied to the gate electrode and the anode electrode and the set AC voltage applied to the cathode electrode is the same as the condition described with reference to FIG. 5A.

Referring to FIG. 6B which illustrates a modification of a waveform of driving voltage Vc2 of cathode electrode 30 illustrated in FIG. 6A, the lower portion of either the sine wave as illustrated in FIG. 6B(3) or the triangular wave as illustrated in FIG. 6B(4) can be used when the three-electrode structure FED is operated. The lower portion refers to the portion of the waveform which is greater than a certain voltage.

A plurality of experiments and comparisons in which a display apparatus constructed with a plurality of two-electrode FEDs is driven or aged will now be described using the method for driving the two-electrode FED according to the principles of the present invention.

Figure 7A:
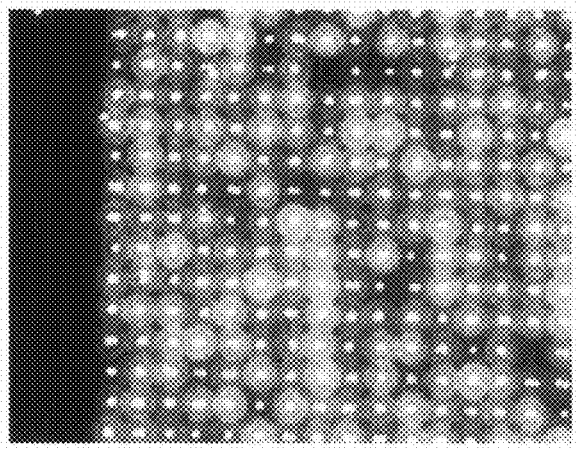
FIGS. 7A through 7C are photographs of FED display apparatuses driven using different constant voltages.
Figure 7B:
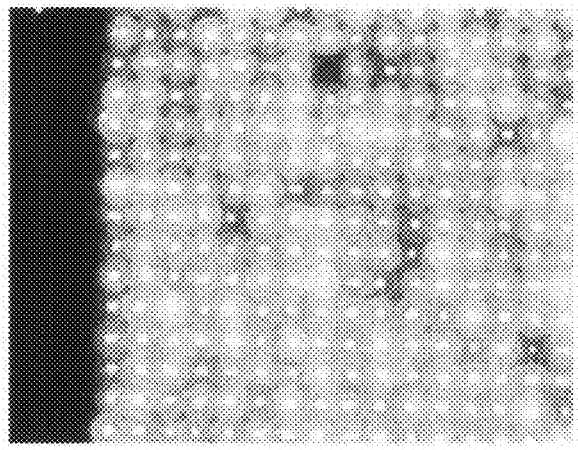
Figure 7C:
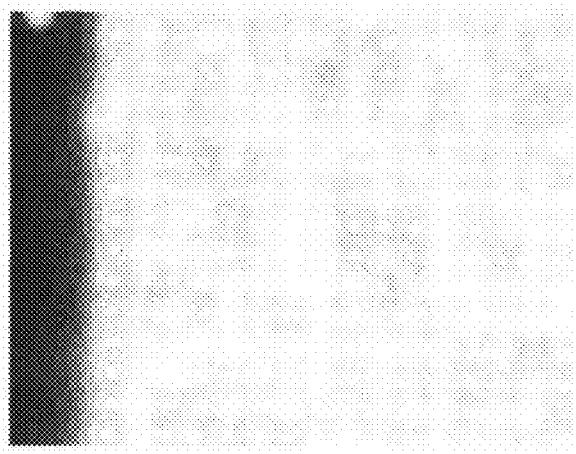

FIGS. 7A through 7C are photographs of FED display apparatuses driven using constant voltages. The right portions of each of the photographs show the activation regions. The left portions which are dark are weak or non-activated regions. Referring to FIGS. 7A through 7C, values described below each of the photographs indicate a voltage at an anode electrode, an emission current, and a uniformity of luminescence, respectively, when a voltage at a cathode electrode is 0 V. Referring to FIG. 7A, a DC voltage of 1600 V is applied to the anode electrode; an emission current is 0.267 mA; and a uniformity of luminescence is 60%. Referring to FIG. 7B, a DC voltage of 1700 V is applied to the anode electrode; an emission current is 0.427 mA; and a uniformity of luminescence is 50%. Referring to FIG. 7C, a DC voltage of 1900 V is applied to the anode electrode; and an emission current is 1.527 mA. Dead spots in the upper center part of the FED display apparatus illustrated in FIG. 7A remain unchanged even if the peak-to-peak value of the driving voltage is increased, and the FED display apparatus has a low uniformity of luminescence as shown in FIGS. 7B and 7C.

Figure 8A:
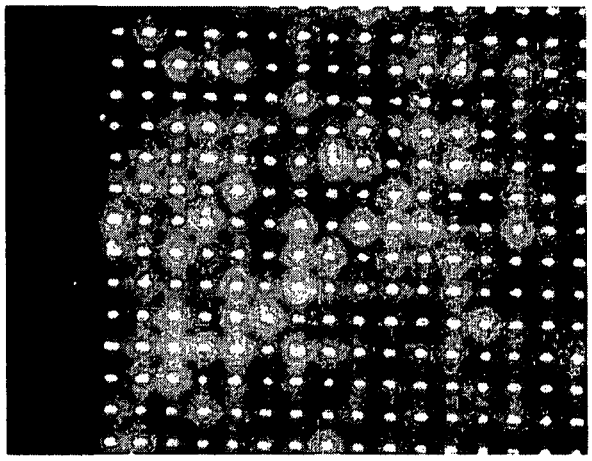
FIGS. 8A through 8C are photographs of the FED display apparatuses illustrated in FIGS. 7A through 7C driven by applying different alternating (AC) voltages to a cathode electrode as illustrated in FIG. 3.
Figure 8B:
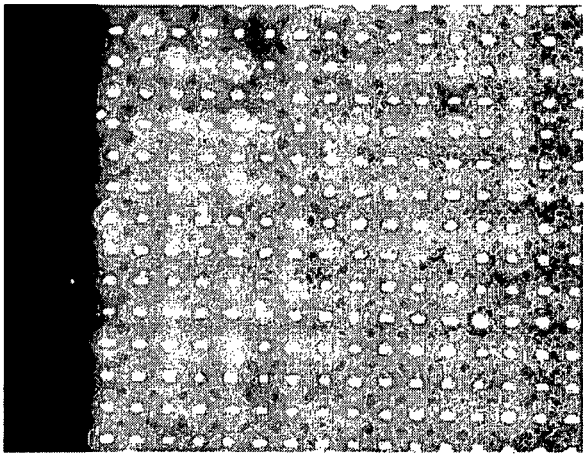
Figure 8C:
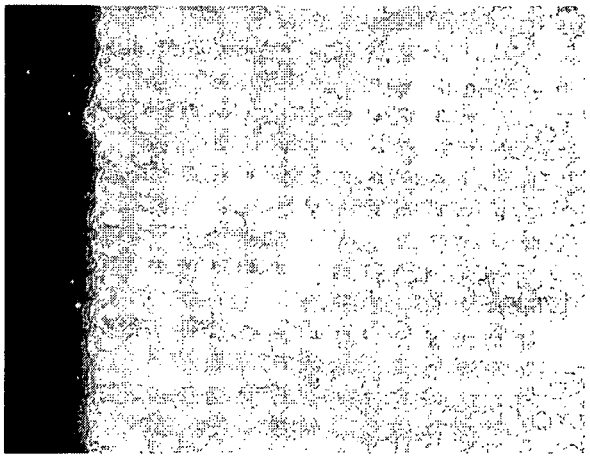

FIGS. 8A through 8C are photographs of the FED display apparatuses illustrated in FIGS. 7A through 7C driven by applying an AC voltage to a cathode electrode as illustrated in FIG. 3. Right portions of each of the photographs are activation regions. Referring to FIGS. 8A through 8C, values described below each of the photographs indicate a peak-to-peak value and the frequency of the AC voltage at the cathode electrode, a DC voltage and emission current of an anode electrode, and a uniformity of luminescence, respectively. Referring to FIG. 8A, an AC voltage of 900 V and a frequency of 120 Hz is applied to the cathode electrode; a DC voltage of 1600 V is applied to the anode electrode; an emission current is 0.194 mA; and a uniformity of luminescence is 69%. Referring to FIG. 8B, an AC voltage of 1000 V and a frequency of 120 Hz is applied to the cathode electrode; a DC voltage of 1000 V is applied to the anode electrode; an emission current is 0.360 mA; and a uniformity of luminescence is 61%. Referring to FIG. 8C, an AC voltage of 1300 V and a frequency of 600 Hz is applied to the cathode electrode; a DC voltage of 1000 V is applied to the anode electrode; and an emission current is 1.390 mA. The uniformity of luminescence of the FED display apparatus illustrated in FIG. 8A is increased by about 1.15 times compared to that of the FED display apparatus illustrated in FIG. 7A. The uniformity of luminescence of the FED display apparatus illustrated in FIG. 8B is increased by about 1.22 times compared to that of the FED display apparatus illustrated in FIG. 7B. Dead spots shown in FIGS. 7A through 7C are activated, and the FED display apparatus has relatively uniform luminescence.

Figure 9A:
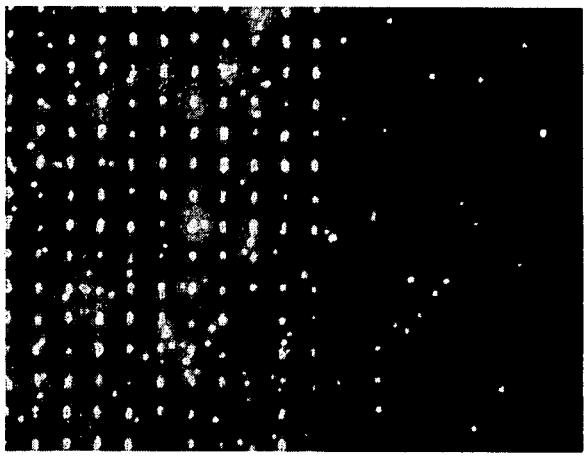
FIGS. 9A through 9C are photographs of the FED display apparatuses respectively illustrated in FIGS. 7A through 7C driven by applying constant voltages to both of the cathode and anode electrodes, a constant voltage and a pulsed voltage respectively to the anode electrode and the cathode electrode, and a constant voltage and an AC voltage respectively to the anode electrode and the cathode electrode, respectively, with respect to the same emission current.
Figure 9B:
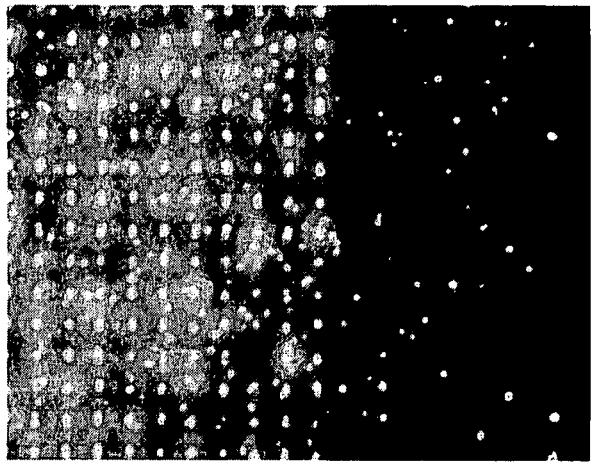
Figure 9C:
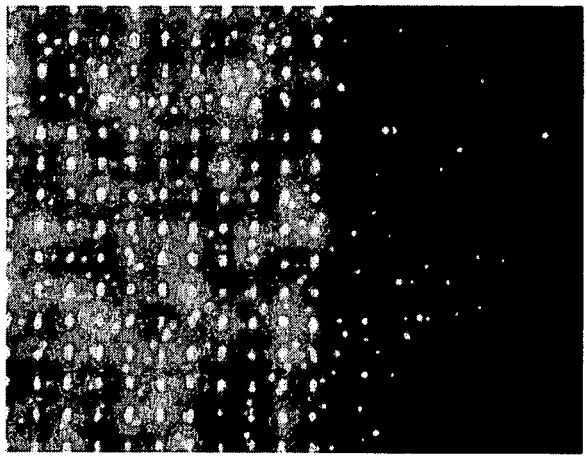
Figure 10A:
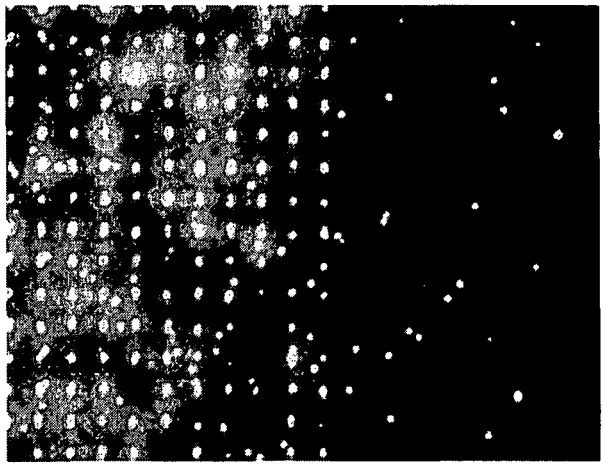
FIGS. 10A through 10C are photographs of the FED display apparatuses respectively illustrated in FIGS. 7A through 7C driven by applying constant voltages to both of the cathode and anode electrodes, a constant voltage and a pulsed voltage respectively to the anode electrode and the cathode electrode, and a constant voltage and an AC voltage respectively to the anode electrode and the cathode electrode, respectively, with respect to the same emission current.
Figure 10B:
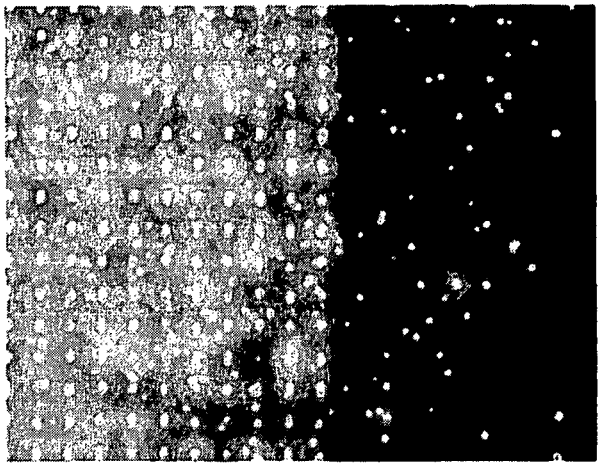
Figure 10C:
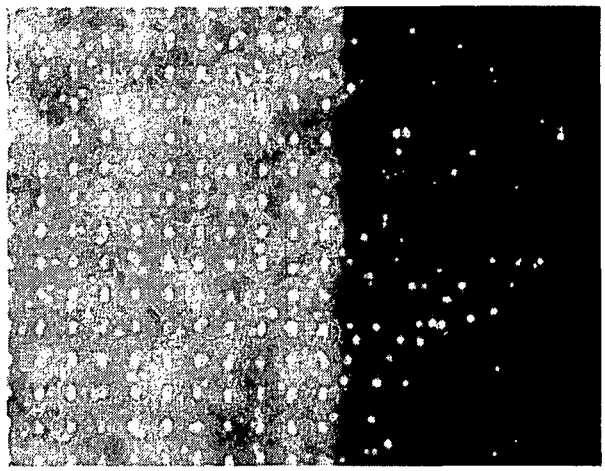
Figure 11A:
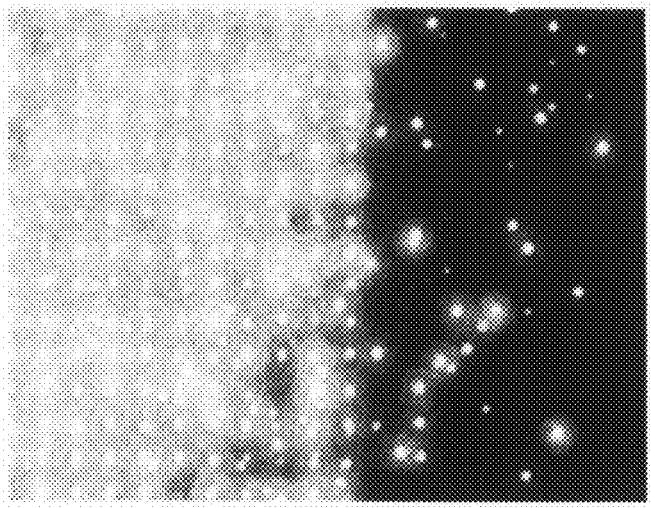
FIGS. 11A through 11B are photographs of the FED display apparatuses respectively illustrated in FIGS. 7A through 7B driven by applying constant voltages to both of the cathode and anode electrodes, a constant voltage and a pulsed voltage respectively to the anode electrode and the cathode electrode, and a constant voltage and an AC voltage respectively to the anode electrode and the cathode electrode, respectively, with respect to the same emission current.
Figure 11B:
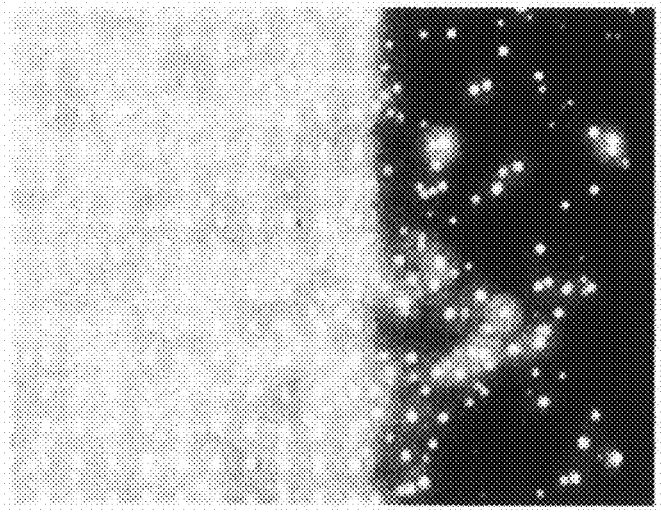
Figure 14A:
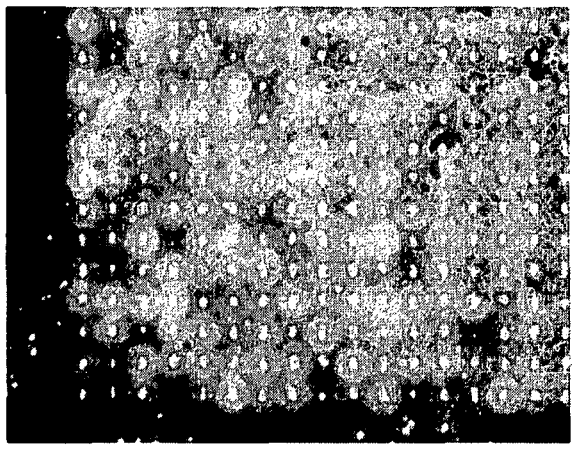
FIGS. 14A through 14C are photographs of the FED display apparatus illustrated in FIG. 13 being aged by applying constant voltages to both of the cathode and anode electrodes, a constant voltage and an AC voltage respectively to the anode electrode and the cathode electrode, and another constant voltage and another AC voltage respectively to the anode electrode and the cathode electrode, in an embodiment of the principles of the present invention.
Figure 14B:
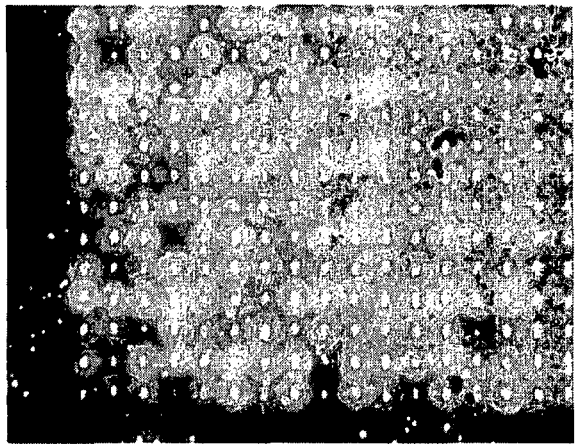
Figure 14C:
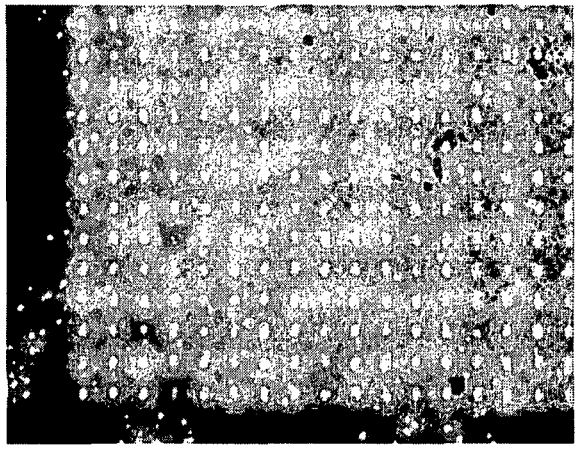

FIGS. 9A through 9C, 10A through 10C, and 11A and 11B are photographs of the FED display apparatuses illustrated in FIGS. 7A through 7C driven by applying constant voltages to both of the cathode and anode electrodes, a constant voltage and a pulsed voltage respectively to the anode electrode and the cathode electrode, and a constant voltage and an AC voltage respectively to the anode electrode and the cathode electrode, respectively, with respect to the same emission current. The left-most portions of each of the photographs show the activation regions. The values described below each of the images in FIGS. 9A, 10A and 11A indicate a DC voltage at the anode electrode, an emission current, and a uniformity of luminescence, respectively, when a voltage at the cathode electrode is 0 A. The values described below each of the images in FIGS. 9B and 10B indicate a pulsed voltage maximum value and frequency of the cathode electrode, a DC voltage and emission current of the anode electrode, and a uniformity of luminescence, respectively. The values described below each of the images in FIGS. 9C, 10C and 11B indicate an AC voltage maximum value and frequency of the cathode electrode, a DC voltage and emission current of the anode electrode, and a uniformity of luminescence, respectively. Referring to FIG. 9A, a DC voltage of 0 V is applied to the cathode electrode; a DC voltage of 1200 V is applied to the anode electrode; an emission current is 0.336 mA; and a uniformity of luminescence is 37%. Referring to FIG. 9B, a pulsed voltage with a value of 565 V and a frequency of 120 Hz is applied to the cathode electrode; a DC voltage of 1000 V is applied to the anode electrode; an emission current is 0.371 mA; and a uniformity of luminescence is 49%. Referring to FIG. 9C, an AC voltage of 700 V and a frequency of 120 Hz is applied to the cathode electrode; a DC voltage of 1000 V is applied to the anode electrode; an emission current is 0.305 mA; and a uniformity of luminescence is 56%. Referring to FIG. 10A, a DC voltage of 0 V is applied to the cathode electrode; a DC voltage of 1200 V is applied to the anode electrode; an emission current is 0.411 mA; and a uniformity of luminescence is 35%. Referring to FIG. 10B, a pulsed voltage with a value of 636 V and a frequency of 120 Hz is applied to the cathode electrode; a DC voltage of 1000 V is applied to the anode electrode; an emission current is 0.483 mA; and a uniformity of luminescence is 39%. Referring to FIG. 10C, an AC voltage of 800 V and a frequency of 120 Hz is applied to the cathode electrode; a DC voltage of 1000 V is applied to the anode electrode; an emission current is 0.450 mA; and a uniformity of luminescence is 51%. Referring to FIG. 11A, the FED display apparatus uses the constant voltages as the driving voltages for both of the cathode electrode and the anode electrode, has overall bright light, and shows dead spots. Referring to FIG. 11B, the FED display apparatus uses the constant voltage and the AC voltage as the driving voltages for the anode electrode and the cathode electrode, respectively, and has bright light throughout its entire region. Referring to FIG. 11A, a DC voltage of 0 V is applied to the cathode electrode; a DC voltage of 1400 V is applied to the anode electrode; and an emission current is 0.961 mA. Referring to FIG. 11B, an AC voltage of 1000 V and a frequency of 120 Hz is applied to the cathode electrode; a DC voltage of 1000 V is applied to the anode electrode; and an emission current is 0.829 mA.

Referring to FIGS. 9A through 9C, the emission current is in a range of about 0.30 to 0.37 mA. Referring to FIG. 9A, the FED display apparatus uses constant voltages of 0 V and 1200 V as the driving voltages for the cathode electrode and the anode electrode, respectively, and has the lowest uniformity of luminescence. Referring to FIG. 9B, the FED display apparatus uses a constant voltage of 1000 V and a pulsed voltage of 565 V at 120 Hz as the driving voltages for the anode electrode and the cathode electrode, respectively, has an increased uniformity of luminescence, and shows dead spots in the right lower part of the activation region. Referring to FIG. 9C, the FED display apparatus uses a constant voltage of 1000 V and a AC voltage of 700 V at 120 Hz as the driving voltages for the anode electrode and the cathode electrode, respectively, has the highest uniformity of luminescence, and shows activated dead spots.

Referring to FIGS. 10A through 10C, the emission current is in a range of about 0.41 mA to 0.48 mA. Since the emission processes as shown in FIGS. 9A through 9C have influences on the following emission processes as shown in FIGS. 10A through 10C, the emission current of FIG. 10A increases to 0.411 mA at the same anode voltage (1200 V) as applied in FIG. 9A. Similar to FIGS. 9A through 9C, when the FED display apparatus uses the constant voltage and the AC voltage as the driving voltages for the anode electrode and the cathode electrode, respectively, the FED display apparatus has the highest uniformity of luminescence, and all electron emission sources are activated.

Referring to FIGS. 11A and 11B, the emission current is in a range of about 0.83 to 0.96 mA. When the FED display apparatus uses the constant voltage and the pulsed voltage as the driving voltage, the FED display apparatus fails to reach the emission current as described above and causes arcing. The experiments show that the method for driving the FED according to an embodiment of the principles of the present invention prevents arcing and remarkably improves uniformity of electron emission.

FIGS. 12A through 12C are photographs of an FED display apparatus using an aging process according to an embodiment of the principles of the present invention. FIG. 12A is a photograph of a constant voltage driving state of the FED display apparatus before being aged. Referring to FIG. 12A, an AC voltage of 0 V at 0 Hz and a DC voltage of 1200 V are applied as driving voltages for the cathode electrode and the anode electrode, respectively. FIG. 12B is a photograph of the FED display apparatus while being aged using a constant voltage and an AC voltage. Referring to FIG. 12B, an AC voltage of 1 kV at 120 Hz and a DC voltage of 1400 V are applied as driving voltages for the cathode electrode and the anode electrode, respectively. The emission current is 92 μA. FIG. 12C is a photograph of a constant voltage driving state of the FED display apparatus after being aged. Referring to FIG. 12C, an AC voltage of 0 V at 0 Hz and a DC voltage of 1400 V are applied as driving voltages for the cathode electrode and the anode electrode, respectively. The emission current is 5 μA. Comparing FIG. 12A and FIG. 12C, a lot of dead spots are activated through the aging process using the AC driving voltage.

Figure 15A:
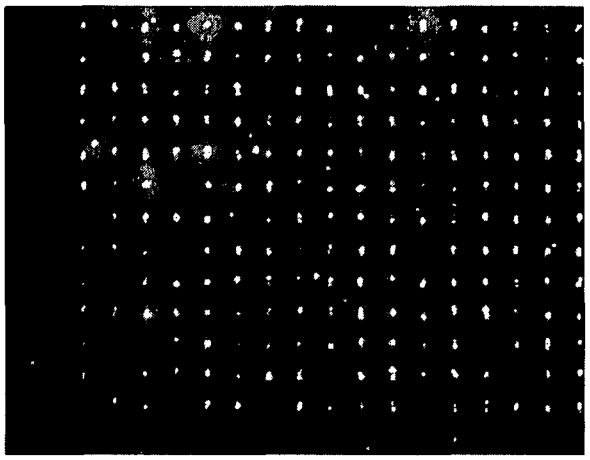
FIGS. 15A through 15C are photographs of the FED display apparatus illustrated in FIG. 13 driven by applying different constant voltages to both of the cathode and anode electrodes, after being aged.
Figure 15B:
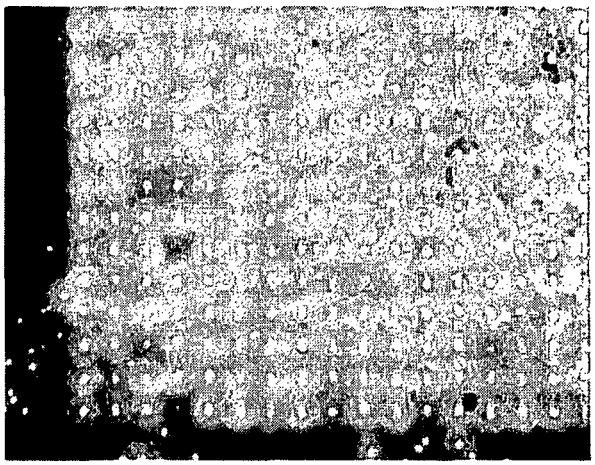
Figure 15C:
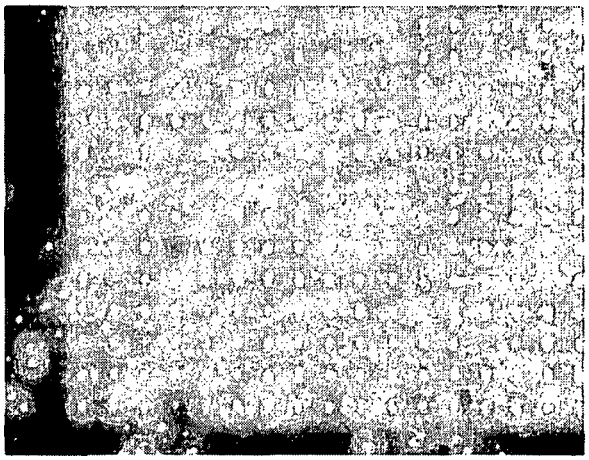

FIGS. 13 through 15C are photographs of an FED display apparatus using an aging process using a driving method according to embodiments of the principles of the present invention. FIG. 13 shows the initial performance of the sample device. FIGS. 14A through 14C show the sample device during the successive aging process. FIGS. 15A through 15C show the sample device after the aging process and being driven for emit light. Referring to FIG. 13, the FED display apparatus uses a constant voltage of 900 V as the driving voltage for the anode electrode and a voltage of 0 V for the cathode electrode before being aged. The emission current is 0.288 mA. Referring to FIG. 14A, the FED display apparatus uses the constant voltage of 1700 V for the anode electrode and a voltage of 0 V for the cathode electrode while being aged. The emission current is 0.288 mA and the uniformity of luminescence is 58%. Referring to FIG. 14B, the FED display apparatus uses the constant voltage of 1700 V and a low AC voltage of 100 V for the anode electrode and the cathode electrode, respectively, while being aged. The emission current is 1.016 mA and the uniformity of luminescence is 60%. Referring to FIG. 14C, the FED display apparatus uses the constant voltage of 800 V and a high AC voltage of 1240 V to the anode electrode and the cathode electrode, respectively, while being aged. The emission current is 1.014 mA and the uniformity of luminescence is 66%. The FED display apparatus that uses a high AC voltage has the most improved uniformity of luminescence. Referring to FIGS. 15A through 15C, the FED display apparatus aged using the condition as described respectively according to FIGS. 14A through 14C, is driven using the constant voltage, 1500 V, 1800 V, and 2000 V, respectively, to the anode electrode. The emission current is 0.271 mA, 1.554 mA and 2.488 mA FIGS. 14A through 14C, respectively. The aged FED display apparatus using the AC voltage has a more improved uniformity of brightness than the FED display apparatus before being aged (FIG. 13) when it is driven using the constant voltage.

The method for driving the FED according to principles of the present invention prevents arcing when the FED emits an electronic beam, considerably reduces occurrence of a hot spot or a dead spot in an FED display apparatus comprising a plurality of FEDs, and improves an uniformity of electron emission. Furthermore, the method for aging the FED according to the principles of the present invention suppresses the hot spots and activates the dead spot.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method for driving a field emission device (FED) comprising a cathode electrode including an emitter and an anode electrode facing the cathode electrode, the method comprising: causing electron emission by applying an alternating voltage to at least one of the anode electrode and cathode electrode of the FED as a driving voltage, and simultaneously applying a constant voltage across the cathode electrode and the anode electrode, with the constant voltage being lower than a threshold voltage causing emission of electrons from the emitter.

2. The method of claim 1, wherein the alternating voltage has a waveform which continuously varies as a function of time when electrons are emitted.

3. The method of claim 2, wherein the waveform of the alternating voltage is one of a sine wave and a triangular wave.

4. The method of claim 1, wherein the alternating voltage is a digital signal having a waveform which substantially continuously varies as a function of time when electrons are emitted.

5. The method of claim 4, wherein the waveform of the alternating voltage is one of a sine wave and a triangular wave.

6. The method of claim 1, wherein the alternating voltage alternates about a threshold voltage, and the threshold voltage is a minimum voltage required for electron emission.

7. A method for driving a two-electrode structure FED comprising a cathode electrode including an electron emission source and an anode electrode facing the cathode electrode, comprising:

applying a constant voltage across the cathode electrode and the anode electrode, with the constant voltage being lower than a threshold voltage causing emission of electrons from the electron emission source; and simultaneously applying an AC voltage to one electrode selected form among the cathode electrode and the anode electrode to thereby enable periodic emission of electrons from the electron emission source.

8. The method of claim 7, comprised of the AC voltage having a waveform which continuously varies as a function of time when electrons are emitted.

9. The method of claim 8, comprised of the waveform of the AC voltage being one of a sine wave and a triangular wave.

10. The method of claim 7, comprised of the AC voltage being a digital signal having a waveform which substantially continuously varies as a function of time when electrons are emitted.

11. The method of claim 10, comprised of the waveform of the AC voltage being one of a sine wave and a triangular wave.

12. The method of claim 7, comprised of the constant voltage being a direct current (DC) voltage in a range of approximately −30 kV to approximately +30 kV.

13. The method of claim 7, comprised of the AC voltage having a maximum peak-to-peak value in a range of 0 to approximately 30 kV, a frequency in a range of 0 to approximately 1 MHz, and a duty rate in a range of approximately $1/10{,}000$ to approximately $1/2$.

14. A method for driving a three-electrode structure FED comprising a cathode electrode including an electron emission source, an anode electrode facing the cathode electrode, and a gate electrode adjacent to the electron emission source, the method comprising:

applying a constant voltage to each one of the cathode electrode, the anode electrode and the gate electrode, with the constant voltage being lower than a threshold voltage causing emission of electrons from the electron emission source; and simultaneously applying an alternating voltage which alternates about a threshold voltage to one electrode selected from among the cathode electrode, the anode electrode and the gate electrode to thereby enable periodic emission of electrons from the electron emission source, wherein the threshold voltage is a minimum voltage required for electron emission.

15. The method of claim 14, wherein the alternating voltage has a waveform which continuously varies as a function of time when electrons are emitted.

16. The method of claim 15, wherein the waveform of the alternating voltage is one of a sine wave and a triangular wave.

17. The method of claim 14, wherein the alternating voltage is a digital signal having a waveform which substantially continuously varies as a function of time when electrons are emitted.

18. The method of claim 17, wherein the waveform of the alternating voltage is one of a sine wave and a triangular wave.

19. The method of claim 14, wherein the constant voltage is a direct current voltage in a range of approximately −30 kV to approximately +30 kV.

20. The method of claim 14, wherein the alternating voltage has a maximum peak-to-peak value in a range of 0 to approximately 30 kV, a frequency in a range of 0 to approximately 1 MHz, and a duty rate in a range of approximately $1/10{,}000$ to approximately $1/2$.

21. A method for aging a two-electrode structure FED comprising a cathode electrode including an electron emission source and an anode electrode facing the cathode electrode, comprising:

applying a constant voltage across the cathode electrode and the anode electrode, with the constant voltage being lower than a threshold voltage causing emission of electrons from the electron emission source; and simultaneously applying an AC voltage to one electrode selected from among the cathode electrode and the anode electrode to thereby enable periodic emission of electrons from the electron emission source.

22. A method for aging a three-electrode structure FED comprising a cathode electrode including an electron emission source, an anode electrode facing the cathode electrode, and a gate electrode adjacent to the electron emission source, the method comprising:

applying a constant voltage to each one of the cathode electrode, the anode electrode, and the gate electrode, with the constant voltage being lower than a threshold voltage causing emission of electrons from the electron emission source; and simultaneously applying an alternating voltage which alternates about a threshold voltage to one electrode selected from among the cathode electrode, the anode electrode and the gate electrode to thereby enable periodic emission of electrons from the electron emission source, wherein the threshold voltage is a minimum voltage required for electron emission.

* * * * *